US006266909B1

(12) United States Patent
Fuchs et al.

(10) Patent No.: US 6,266,909 B1
(45) Date of Patent: Jul. 31, 2001

(54) PISTOL HAVING A SAFETY FOR PREVENTING FIRING DURING DISASSEMBLY

(75) Inventors: Rudolf Fuchs, Thayngen (CH); Michael Osterrath, Jestetten (DE)

(73) Assignee: SIG Arms International AG, Neuhausen am Rheinfall (CH)

( * ) Notice: Subject to any disclaimer, the term of this patent is extended or adjusted under 35 U.S.C. 154(b) by 0 days.

(21) Appl. No.: 09/234,420

(22) Filed: Jan. 20, 1999

(51) Int. Cl.[7] ..... F41A 21/00
(52) U.S. Cl. ..... 42/75.01; 42/70.05; 89/148
(58) Field of Search ..... 42/75.01, 70.01, 42/70.05, 70.08, 69.02; 89/148, 132

(56) References Cited

U.S. PATENT DOCUMENTS 2,829,563 * 4/1958 Butler ..... 89/144
4,203,348 * 5/1980 Sokolovsky ..... 89/148
4,523,510 * 6/1985 Wilhelm ..... 89/141
5,493,806 * 2/1996 Langevin et al. ..... 42/69.02
5,615,507 * 4/1997 French ..... 42/69.02
5,736,667 * 4/1998 Munostes et al. ..... 89/132
6,070,512 * 6/2000 Rohrbaugh ..... 89/147

* cited by examiner

*Primary Examiner*—Michael J. Carone
*Assistant Examiner*—Michelle Thomson
(74) *Attorney, Agent, or Firm*—Venable; Gabor J. Kelemen

(57) ABSTRACT

A pistol includes a frame; a slide mounted on the frame for forward and rearward motions relative to the frame to assume a forward, basic position and a rearward, pulled-back position; a firing pin mounted in the slide for forward and rearward motions relative to the slide; a firing pin catch affixed to the firing pin and movable therewith as a rigid unit; a firing pin spring mounted in the slide and urging the firing pin in a forward direction; a trigger movably supported in the frame; a trigger rail coupled to the trigger for executing a triggering motion when the trigger is pulled; and a sear for operatively connecting the trigger rail with the firing pin catch such that during forward motion of the slide the sear arrests and holds the firing pin catch whereby the firing pin spring is armed and that upon pulling the trigger, the sear is moved away from the firing pin catch by the trigger rail for allowing the firing pin to accelerate forwardly as urged by the firing pin spring. A manually operable safety is movable into a disassembly position for causing the sear to bypass the firing pin catch during forward motion of the slide for preventing arming of the firing pin spring during forward motion of the slide.

12 Claims, 5 Drawing Sheets

PISTOL HAVING A SAFETY FOR PREVENTING FIRING DURING DISASSEMBLY

FIELD AND BACKGROUND OF THE INVENTION

This invention relates to a hand weapon, such as a pistol, and is particularly concerned with a safety mechanism for preventing an accidental firing of the weapon in the course of a disassembling operation.

European Patent No. 77,790 discloses a pistol having a frame and a slide which is displaceable thereon and in which a breechblock (referred to hereafter as a "bolt") is disposed. A spring-loaded firing pin, having a firing pin catch, is slidably received in the bolt. To a pivotal trigger a trigger rail is articulated which, at its rear, is jointed to a sear lever which arrests and holds the firing pin catch during the forward motion of the slide/bolt assembly, whereby the firing pin spring is armed. Upon pulling the trigger, the rearward end of the trigger rail runs up on a control cam of a leaf spring and, as a result, the trigger rail is lowered. This occurrence also causes a lowering of the sear lever and thus the firing pin is released and urged forwardly by the firing pin spring. After a shot is fired, the slide recoils on the frame. At the same time, a cam track provided on the bolt laterally displaces the leaf spring so that its control cam is out of engagement with the trigger rail and thus the latter, together with the sear lever, is pivoted upwardly. Thereafter, during the successive recuperating motion of the slide, the firing pin catch is again caught by the sear lever.

The above-described trigger mechanism is relatively complex and requires a great number of individual components. Since during arming of the firing pin spring the sear lever executes a pivotal motion, it may only provide a linear contact with the firing pin catch which results in a relatively substantial wear and requires significant maintenance. The bolt is separately installed in the slide which increases manufacturing costs.

In case the above-described prior art pistol is to be disassembled, first the magazine is removed from the grip well and by performing a charging operation (that is, by pulling back and releasing the slide), a cartridge which may have remained in the pistol chamber is ejected. A transverse pin which secures the slide on the frame is depressed. Since the firing pin catch is still held back by the sear lever, in this position the slide may not yet be pulled off the frame in a forward direction. To allow such a removal, first the trigger has to be pulled. In case an earlier loading motion has not been fully performed or in case the unloading operation has been performed in a reverse sequence, risks are considerable that an unintentional and thus uncontrolled shot is fired.

SUMMARY OF THE INVENTION

It is an object of the invention to provide an improved pistol of the above-outlined type from which at least one of the above-discussed disadvantages is eliminated.

This object and others to become apparent as the specification progresses, are accomplished by the invention, according to which, briefly stated, the pistol includes a frame; a slide mounted on the frame for forward and rearward motions relative to the frame to assume a forward, basic position and a rearward, pulled-back position; a firing pin mounted in the slide for forward and rearward motions relative to the slide; a firing pin catch mounted on the firing pin; a firing pin spring mounted in the slide and urging the firing pin in a forward direction; a trigger movably supported in the frame; a trigger rail coupled to the trigger for executing a triggering motion when the trigger is pulled; and a sear for operatively connecting the trigger rail with the firing pin catch such that during forward motion of the slide the sear arrests and holds the firing pin catch whereby the firing pin spring is armed and that upon pulling the trigger, the sear is moved away from the firing pin catch by the trigger rail for allowing the firing pin to accelerate forwardly as urged by the firing pin spring. A manually operable safety is movable into a disassembly position for causing the sear to bypass the firing pin catch during forward motion of the slide for preventing arming of the firing pin spring during forward motion of the slide.

DESCRIPTION OF THE PREFERRED EMBODIMENT

Figure 1:
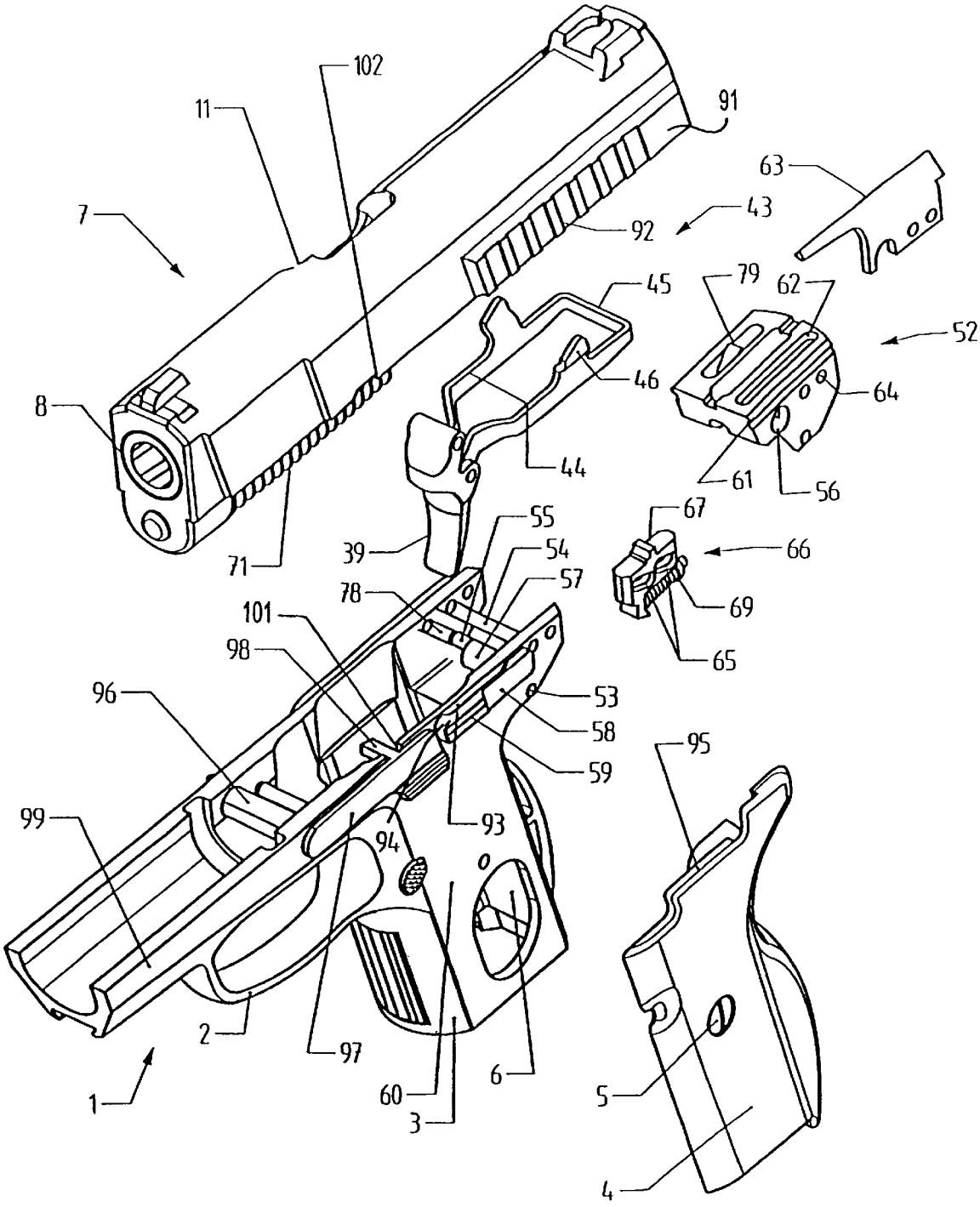
FIG. 1 is a perspective exploded view of components of a pistol incorporating a preferred embodiment of the invention.

Turning to FIG. 1, the pistol illustrated therein includes a cross-sectionally U-shaped frame 1 which has a formed-on trigger guard 2 and a grip body 3 to which grip plates 4 are secured by screws 5. In the grip body 3 a clip well 6 is formed for receiving a non-illustrated cartridge clip (magazine). A slide 7 is mounted on the frame 1 and is guided thereby for linear reciprocation between a forward, basic position and a rearward, pulled-back position. A barrel 8 is longitudinally displaceably mounted in the slide 7 and is, in the basic position, in engagement with an abutment shoulder 9 of the slide 7. The slide 7 has, on the right side on front of the shoulder 9, an ejection opening 11 through which an ejector throws out an empty shell from the chamber 10 of the barrel 8.

Figure 2:
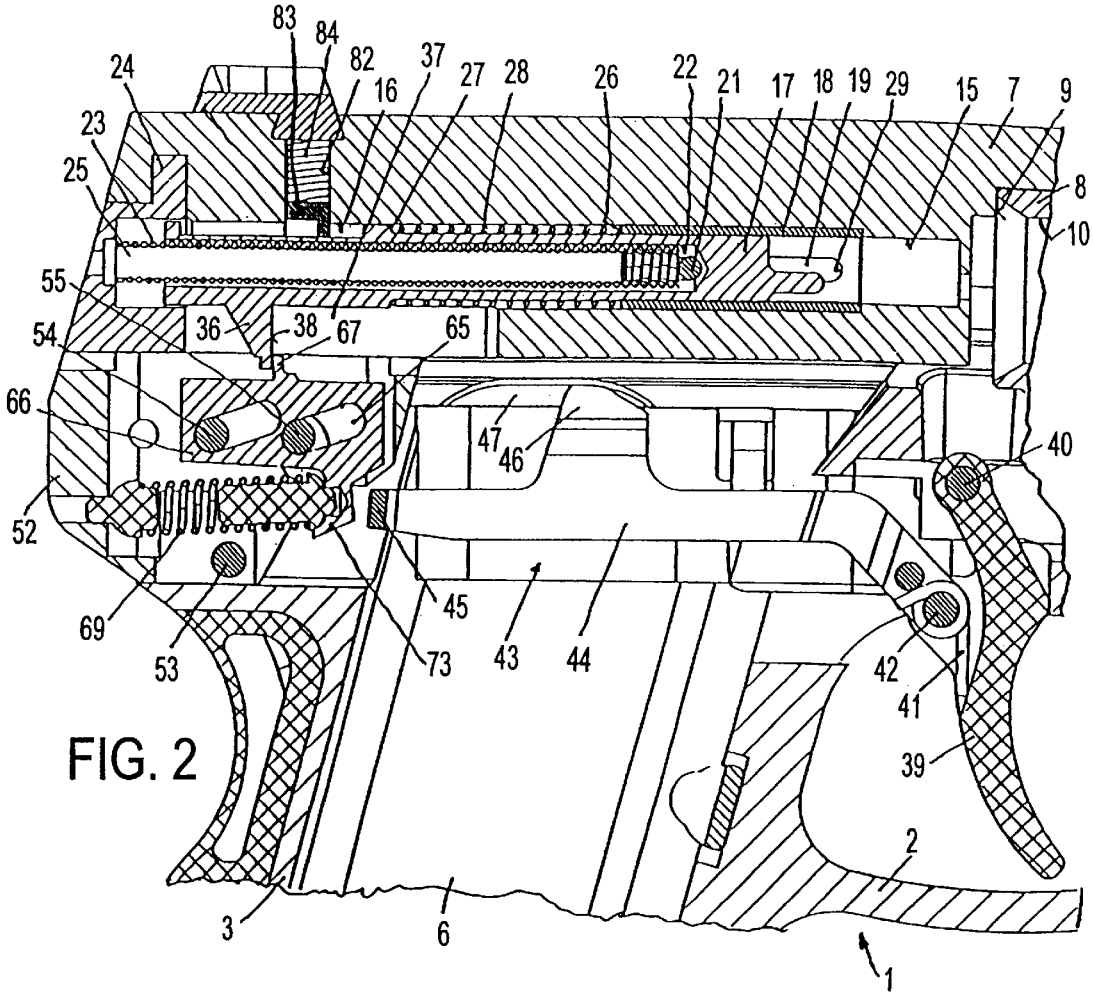
FIGS. 2, 3, 4 and 5 are sectional side elevational views of a rear region of the pistol, depicted in four different operational positions.
Figure 3:
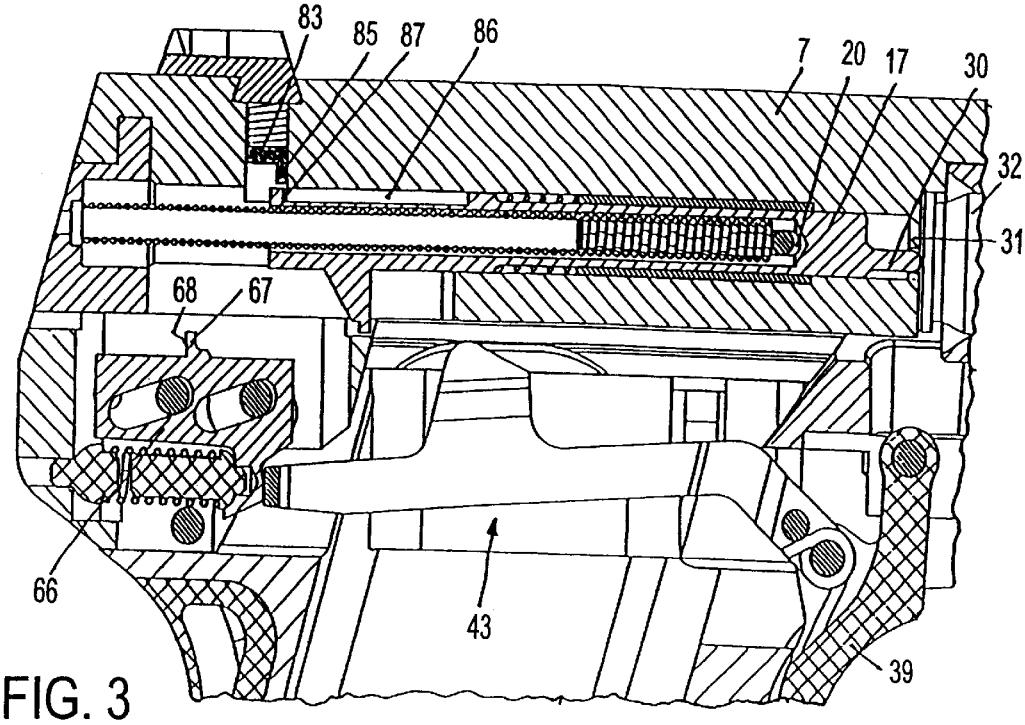

Turning to FIGS. 2 and 3, in a stepped longitudinal bore 15, 16 of the slide 7 a firing pin 17 is guided for longitudinal displacements. In the enlarged portion 16 of the bore 15, 16 a sleeve 18 is accommodated which surrounds the firing pin 17 and which has a transversely throughgoing slot 19. In the region of the slot 19 the firing pin 17 is provided with a slot 20 which is significantly shorter than the slot 19. A transverse pin 21 passes through the slots 19, 20. The firing pin 17 has a coaxial blind bore 22 which extends to the frontal edge of the slot 20 and which accommodates a coil spring 23 for the firing pin 17. At its frontal end the firing pin spring 23 engages the pin 21 while at its rearward end the firing pin spring 23 is in engagement with a bottom 24 inserted in the slide 7. The spring 23 is guided by a rod 25 coaxially disposed inside the spring 23. A return spring 28 is inserted between the rear end face 26 of the sleeve 18 and a shoulder 27 of the firing pin 17. For firing a shot, the firing pin 17 is accelerated forwardly by the spring 23 until the pin 21 abuts the frontal edge 29 of the slot 19. The firing pin 17 continues to move forwardly by virtue of its inertia until the rearward edge of the slot 20 abuts the pin 21. During this occurrence, the eccentrically disposed firing pin tip 30 ignites a cartridge 32 situated in the chamber 10, as depicted in FIG. 3. In the relaxed state of the spring 23 the pin 21, urged by the return spring 28, engages the frontal edge of the slot 20 so that the firing pin tip 30 is situated inside the bottom 31 of the blind bore 15.

At the lower side of the firing pin 17 a catch lug 36 is formed which passes through a longitudinally extending slot 37 of the slide 7 and projects beyond the underside thereof. The catch lug 36 has, at least in its region which projects beyond the slot 37, a forwardly oriented end face 38 which lies in a radial plane of the firing pin 17. In the frame 1 a trigger 39 is pivotally mounted on a transverse pin 40 and is forwardly biased by a trigger spring 41. To a transverse pin 42 mounted on the trigger 39 a trigger rail 43 is articulated which has two legs 44 straddling an inserted magazine (not shown). At their rearward end the legs 44 are interconnected by a web (abutment member) 45. Each leg 44 carries a respective cam 46 extending into longitudinal grooves (recesses) 47 of the slide 7 when the latter is in its basic position. The trigger rail 43 is biased upwardly by the trigger spring 41 which thus also acts as a trigger rail spring.

Figure 1A:
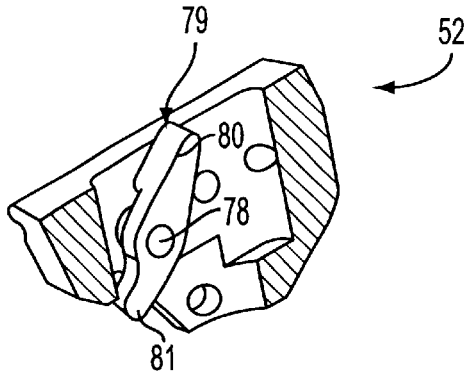
FIG. 1*a* is a sectional perspective view of a component shown in FIG. 1.
Figure 1B:
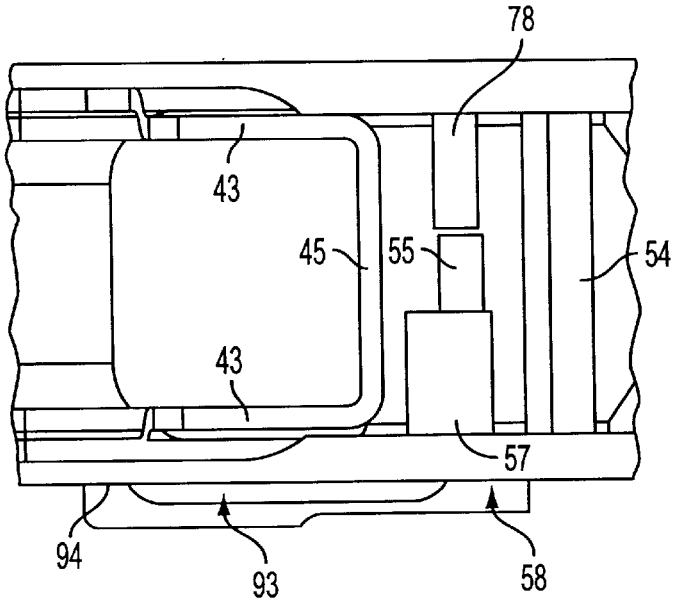
FIG. 1*b* is a top plan view of a detail shown in FIG. 1.
Figure 5:
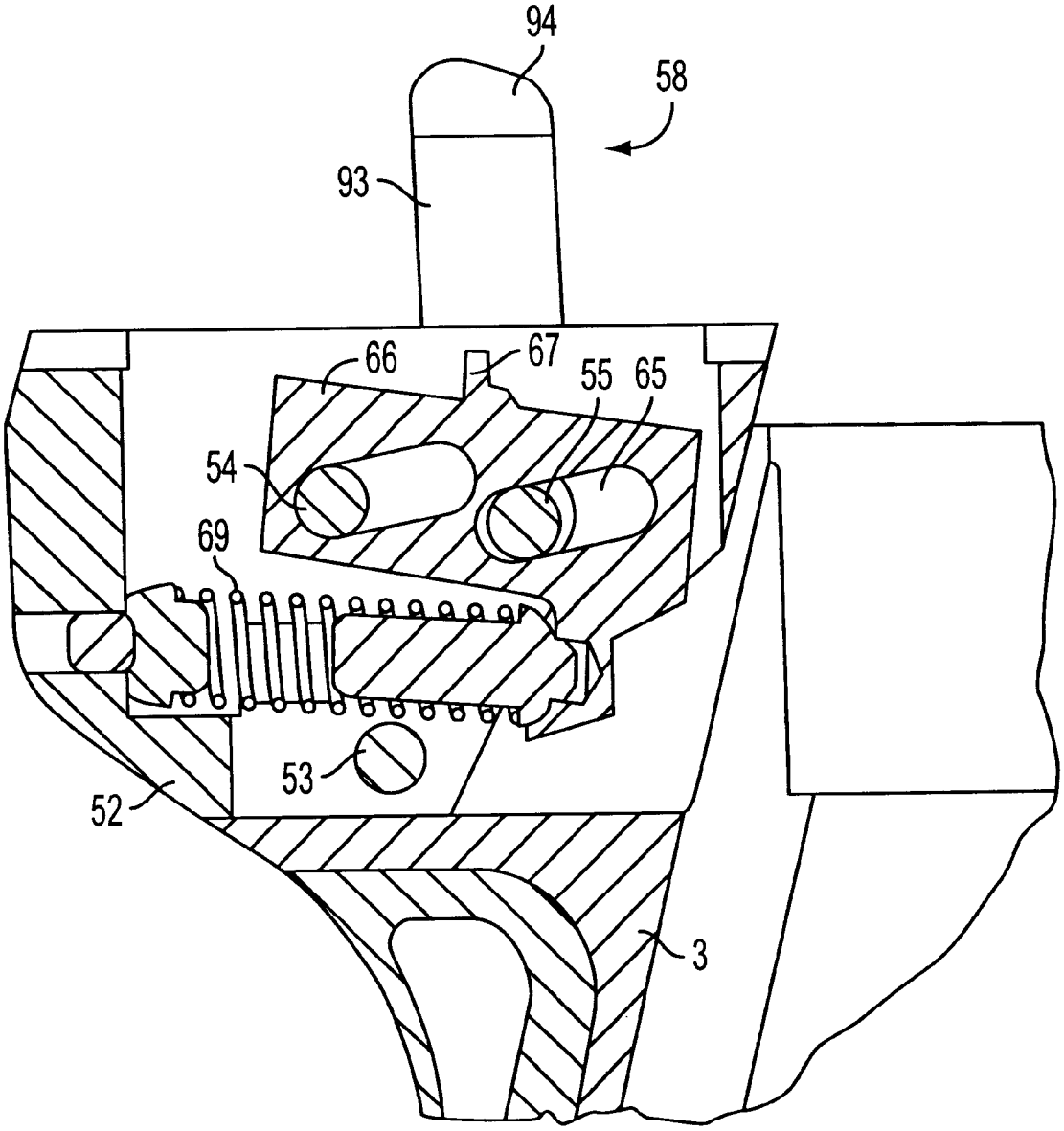

Also referring to FIGS. 1, 1*b* and 5, in the rear region of the frame 1 an insert 52 is accommodated which is secured to the frame 1 by two transverse pins 53 and 54. A control lever 58, having manually engageable knurls 59 is situated externally, on the left side of the frame 1, and is held on the surface 60 of the frame 1 by the left-side grip plate 4. A transverse pin 57, affixed to the control lever 58, passes through a bore hole 56 of the insert 52 and may journal therein. A further transverse pin 55 is affixed to the end of the pin 57 such that the pin 55 is eccentric to, but axially parallel with the pin 57. As particularly well seen in FIG. 5, the pin 55 stops short of the opposite side of the slide 7. The lever 58 may be pivoted upwardly by 90° into its disassembly position from its basic position shown in FIG. 1. In the basic position of the lever 58 the plane containing the axes of the two pins 54, 55 extends parallel to the axis of the firing pin 17. In contrast, in the disassembly position (upwardly pivoted position) of the control lever 58 the pin 55 is lowered, as shown in FIG. 5. The insert 52 has on its upper part, on both sides, a respective guide rail 61 on which the slide 7 is guided. The insert 52 further has a longitudinal slot 62 in which an ejector 63 is positioned and secured by the pin 54 and by an additional short pin 64. The eccentric position of the firing pin tip 30 is advantageous in that the bore 15, 16 is located further upward, whereby sufficient space is available to provide, in the slide 7, a longitudinal groove in which the ejector 63 glides.

Referring to FIGS. 2–5, a sear member (sear plate) 66 has rearwardly downward inclined slots 65 through which respective pins 54, 55 pass for holding and guiding the sear plate 66 for displacements parallel to itself. The sear plate 66 has an upwardly projecting, formed-on catch lug 67 provided with a rearward face 68 which, in the basic position of the lever 58, extends parallel to the frontal end face 38 of the firing pin catch 36. The faces 38 and 68 change at sharp edges in perpendicularly oriented or slightly acutely angled surfaces. The sear plate 66 is urged by a sear spring 69 into the basic position shown in FIGS. 2 and 4 in which the pins 54, 55 abut the rearward terminal edge of the slots 65. The catch lug 67 of the sear plate 66 is, in such a position, in the travelling path of the firing pin catch 36.

Upon executing a charging motion, that is, upon manually pulling the slide 7 rearwardly while the firing pin is in a released state, the firing pin catch 36 pushes the sear plate 66 rearwardly against the force of the spring 69 until the firing pin catch 36 glides past above the catch lug 67 of the sear plate 66. During the successive forward motion of the slide 7 urged by a slide-closing spring 71 (FIG. 1), the firing pin catch 36 is caught by the catch lug 67 of the sear plate 66 whereby the firing pin spring 23 is armed.

Figure 4:
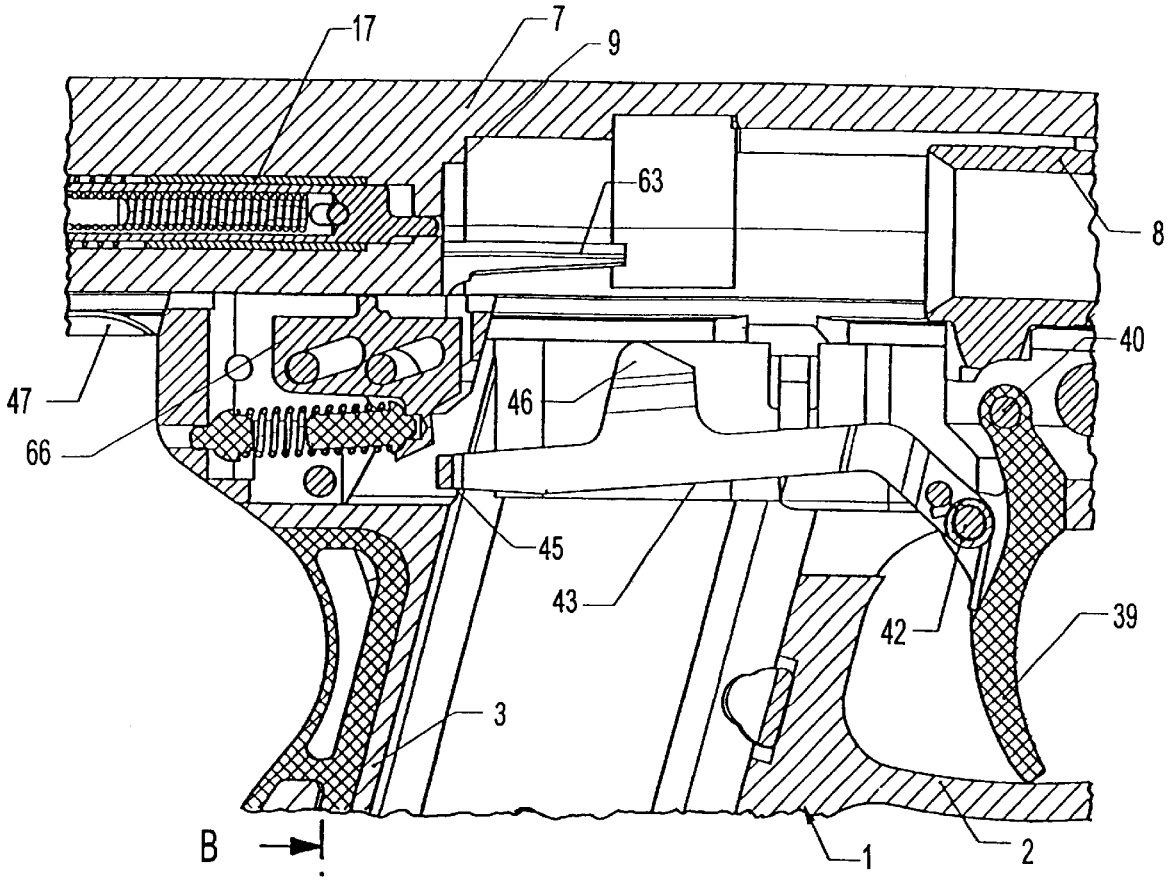

When the trigger 39 is pulled against the force of the trigger spring 41, after a certain trigger path the web 45 abuts a lug 73 of the sear plate 66 and pushes the sear plate 66 against the force of the springs 69 and 23 rearwardly until the catch lug 67 disengages from the firing pin catch 36. As a result of such an occurrence, the firing pin 17 is released and accelerated forward by the firing pin spring 23, whereupon a shot is fired, as illustrated in FIG. 3. During the successive recoil of the slide 7, the cams 46 of the trigger lever 43 run at the frontal end of the grooves 47 onto the slide 7 so that the trigger rail 43 is pivoted downwardly and the sear plate 66 snaps back into its basic position as shown in FIG. 4 in which, during the forward motion (recuperating motion) of the slide 7 which follows its recoil, the catch lug 67 of the sear plate 66 again arrests and holds the firing pin catch 36, thus arming the firing pin 17.

With particular reference to FIGS. 1, 1*a* and 1*b*, adjacent the sear plate 66 a two-arm lever 79 is pivotally supported in the insert 52 on a short pin 78 which is coaxial with the pin 55 in the basic position of the lever 58. The upper arm 80 of the lever 79 projects beyond the upper side of the insert 52. The lower arm 81 of the lever 79 is situated adjacent the lug 73 of the sear plate 66, and the arm 81 is pushed together with the lug 73 rearwardly by the web 45 when the trigger 39 is pulled. During this occurrence the upper arm 80 of the lever 79 pushes upwardly a safety slide 83 against the force of a compression spring 84, as seen in FIGS. 2 and 3. The safety slide 83 is slidably guided in a vertical channel 82 provided in the slide 7. The safety slide 83 has a downwardly projecting narrow strip 85 which extends transversely to the axis of firing pin 17. The strip 85, in its basic position as shown in FIG. 2, extends into a longitudinal transverse groove 86 of the firing pin 17. The rearward shoulder 87 of the groove 86 and the longitudinal position of the strip 85 are designed such that the firing pin tip 30 does not project beyond the bottom 31 when the shoulder 87 abuts the strip 85. This purpose is served by the slot 20 and the firing pin return spring 28. After firing a shot, the firing pin 17 is immediately returned by the spring 28 into the safety detent position. Should, for example, a cartridge misfire upon pulling the trigger 39, the strip 85 assumes its detent position in front of the shoulder 87 when the trigger 39 is released, allowing it to pivot forwardly by the trigger spring 41. If in such a position the pistol is dropped, the firing pin tip 30 cannot again impact on the primer of the earlier misfired cartridge. Even if the firing pin spring 23 is in an armed state (FIG. 2), such a firing pin safety prevents accidental firing caused by blows. For example, a blow on the slide 7 from the rear which would be sufficiently powerful to accelerate the sear plate 66 rearwardly into its release position, cannot, at the same time, accelerate the safety slide 83 upwardly and thus the firing pin 17 remains blocked. This type of firing pin safety is described in more detail in Swiss Patent No. 528,057 in conjunction with a striker hammer type ignition.

Particularly referring to FIGS. 1 and 1*b*, the slide 7 has in its rearward region an external lateral projection 91 provided with gripping grooves 92 for a manual loading of the pistol. The control lever 58 has, at its side oriented towards the surface 60, a groove 93 which is slightly wider than the width of the projection 91, as viewed in a transverse, horizontal direction. At its free end the lever 58 has a projection 94 extending towards the surface 60. In the basic position of the slide 7 the control lever 58 cannot be pivoted because in the downward direction displacement is prevented by the abutment of the projection 94 on an end face 95 of the grip plate 4 and in the upward direction motion is prevented by the abutment on the projection 91 of the slide 7. In contrast, in the open (pulled-back) position of the slide 7, as shown in FIG. 4, the projection 91 is situated behind the control lever 58 so that the latter may be pivoted 90° upwardly as shown in FIG. 5. During such an upward pivotal motion of the lever 58, the pin 55 is lowered so that the catch lug 67 of the sear plate 66 is moved out of the motion path of the firing pin catch 36. After pulling out a disassembly lever 97 and its integral pin 96, the slide 7 may be pulled off the frame 1 by moving the slide 7 forwardly. During this occurrence the projection 91 of the slide 7 glides through the groove 93 of the lever 58.

When the magazine is empty and the last shot is fired, the slide 7, after recoil, is caught by a catch lug 98 of the disassembly lever 97 as the catch lug 98 drops into in a catch notch 102 provided in the slide 7. The disassembly lever 97 may be manually pressed downwardly to cause the catch lug 98 to move out of the notch 102, whereupon the slide 7 may move forwardly. Since the control lever 58 must be pivoted in the opposite direction for disassembly, an accidental erroneous manipulation during closing of the slide 7 is not possible.

Figure 1C:
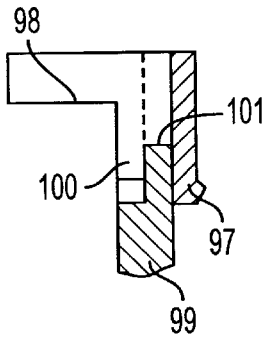
FIG. 1*c* is a fragmentary sectional end elevational view taken through the slide catch release lever.

With particular reference to FIGS. 1 and 1*c*, the catch lug 98 of the disassembly lever 97 has, on the inner side of the wall 99 on which the disassembly lever 97 lies, a downwardly oriented projection 100 which, in the normal position of the lever 97 (as opposed to its upwardly pivoted, disassembly position) extends below a notch 101 provided in the wall 99. Consequently, in the normal position of the disassembly lever 97 the latter may not be pulled out of the frame 1 for initiating the disassembling operation, because the projection 100 abuts the inside face of the wall 99 of the frame 1. Thus, the disassembly lever 97 may be pulled out of the frame 1 only if such an abutting relationship between the projection 100 and the inner face of the wall 99 does not exist which is the case in an upwardly pivoted position of the disassembly lever 97. The disassembly lever 97 may be pivoted into its raised position, in turn, only in the open position of the slide 7, because in all other positions the slide 7 prevents the catch lug 98 from swinging upwardly. The pistol thus may be disassembled exclusively when the slide 7 is entirely open. An accidental erroneous manipulation during disassembly, including an unintended firing, can therefore not take place.

Since for disassembling the pistol the control lever 58 must be actuated when the slide 7 is in its pulled-back (open) position, the firing pin spring 23 is in a relaxed state. In a successive closing of the slide 7 the firing pin catch 36 is not caught by the catch lug 67 of the sear plate 66 (because the sear plate guiding pin 55 has been lowered due to the upward motion of the lever 58) and thus the firing pin 17 remains in the unarmed state (that is, the firing pin spring 23 remains relaxed) despite the closing (forward motion) of the slide 7. The trigger thus need not be pulled for taking off the slide 7 from the frame 1 in a forward direction. Even if the user, because of habit acquired in the handling of conventional pistols, additionally pulls the trigger 39 for taking the slide 7 off the frame 1, such an operation has no effect because a rearward motion of the sear plate 66 remains out of contact with the firing pin catch 36. Further, the firing pin 17 is secured by the slide 83, as it was described earlier. Even if an unloading process is performed incorrectly, it is not possible to fire a shot during disassembly. Thus, the pistol according to the invention has a multiple safety.

The guidance of the sear plate 66 parallel with itself has the advantage that the firing pin catch 36 lies face-to-face on the catch 67 until the firing pin 17 is released. In this manner, an edgewise contacting and a wear involved therewith are avoided. By virtue of the separate sear plate spring 69 the pressure point force may be changed by replacing the spring 69 by another spring having a different spring constant or a different bias. The trigger path too, may be altered by replacing the sear plate 66.

It will be understood that the above description of the present invention is susceptible to various modifications, changes and adaptations, and the same are intended to be comprehended within the meaning and range of equivalents of the appended claims.

What is claimed is:

1. A pistol comprising (a) a frame;

(b) a slide mounted on said frame for forward and rearward motions relative to said frame to assume a forward, basic position and a rearward, pulled-back position;

(c) a firing pin mounted in said slide for forward and rearward motions relative to said slide;

(d) a firing pin catch affixed to said firing pin and movable therewith as a rigid unit;

(e) a firing pin spring mounted in said slide and urging said firing pin in a forward direction;

(f) a trigger movably supported in said frame;

(g) a trigger rail coupled to said trigger for executing a triggering motion when said trigger is pulled;

(h) sear means for operatively connecting said trigger rail with said firing pin catch such that during forward motion of said slide said sear means arrests and holds said firing pin catch whereby said firing pin spring is armed and that upon pulling said trigger, said sear means is moved away from said firing pin catch by said trigger rail for allowing said firing pin to accelerate forwardly as urged by said firing pin spring; and (i) manually operable safety means movable into a disassembly position for causing said sear means to bypass said firing pin catch during forward motion of said slide for preventing arming of said firing pin spring during forward motion of said slide.

2. The pistol as defined in claim 1, wherein said safety means comprises locking means for allowing movement of said safety means solely in said pulled-back position of said slide.

3. The pistol as defined in claim 1, wherein said firing pin has a longitudinal axis and a firing pin tip for striking a primer of a cartridge; said firing pin tip being eccentric relative to said firing pin axis.

4. The pistol as defined in claim 1, wherein said sear means includes a sear member having a catch lug; further comprising a sear supporting arrangement movably holding said sear member in said frame; said sear supporting arrangement having a normal position in which said catch lug of said sear member is situated in a path of travel of said firing pin catch for arresting said firing pin catch during forward motion of said slide; said sear supporting arrangement having a bypass position in which said catch lug of said sear member is situated outside said path of travel of said firing pin catch for causing said catch lug of said sear member to bypass said firing pin catch during forward motion of said slide; said safety means being connected to said sear supporting arrangement for moving said sear supporting arrangement into said bypass position when said safety means is moved into said disassembly position.

5. The pistol as defined in claim 4, wherein said sear supporting arrangement comprises a first pin extending into said sear member; said safety means comprises a manually operable safety lever supported on said frame and a second pin having an axis and being affixed to said safety lever for rotation about said axis when said safety lever is moved into said disassembly position; said first pin being affixed to said second pin; said first pin being axially parallel and eccentric to said second pin.

6. The pistol as defined in claim 4, wherein said firing pin has a longitudinal firing pin axis; further wherein said supporting arrangement comprises slots provided in said sear member and first pins extending into respective said slots for guiding said sear member in a direction inclined to said firing pin axis during said displacements thereof; wherein said safety means comprises a manually operable safety lever supported on said frame and a second pin having an axis and being affixed to said safety lever for rotation about said axis when said safety lever is moved into said disassembly position; one of said first pins being affixed to said second pin and being axially parallel and eccentric to said second pin.

7. The pistol as defined in claim 1, wherein said firing pin has a longitudinal firing pin axis; further wherein said sear means comprises a sear member and a supporting arrangement for movably supporting said sear member in said frame for displacements in a direction inclined to said firing pin axis; said sear member having a catch lug; said sear means further comprising a sear spring urging said sear member into a position in which said catch lug is situated in a path of travel of said firing pin catch during forward motion of said slide; said trigger rail having an abutting member cooperating with said sear member for shifting said sear member and moving said catch lug of said sear member out of said travel path of said firing pin catch when said trigger is pulled.

8. The pistol as defined in claim 7, wherein said supporting arrangement comprises slots provided in said sear member and pins extending into respective said slots for guiding said sear member during said displacements thereof.

9. The pistol as defined in claim 7, wherein said trigger rail is articulated to said trigger; further comprising a trigger rail spring urging said abutting member of said trigger rail toward said sear member; further comprising means for depressing said trigger rail against a force of said trigger rail spring when said slide is in a position other than said basic position for moving said abutting member away from said sear member.

10. The pistol as defined in claim 9, wherein said means for depressing said trigger rail comprises a projection formed on said trigger rail and a cam track provided on said slide for depressing said projection in a position of said slide other than said basic position.

11. The pistol as defined in claim 7, further comprising an insert removably mounted in said frame; said sear member and said sear spring being accommodated in said insert; further comprising lateral guide rails provided on said insert for guiding said slide on said frame.

12. The pistol as defined in claim 11, further comprising a shell case ejector mounted in said insert.

* * * * *